US005086524A

United States Patent [19]

Stevens

[11] Patent Number: 5,086,524

[45] Date of Patent: Feb. 11, 1992

[54] DOUBLE-ACTING WATER CLOSET METERING DEVICE

[76] Inventor: Charles F. Stevens, 20192 Rockville Ct., Yorba Linda, Calif. 92686

[21] Appl. No.: 674,595

[22] Filed: Mar. 25, 1991

Related U.S. Application Data

[60] Division of Ser. No. 519,430, May 4, 1990, Pat. No. 5,040,247, which is a division of Ser. No. 189,152, May 2, 1988, Pat. No. 4,937,895, which is a continuation-in-part of Ser. No. 51,297, May 15, 1987, Pat. No. 4,748,699.

[51] Int. Cl.[5] ..... E03D 1/00

[52] U.S. Cl. ..... 4/415; 4/325

[58] Field of Search ..... 4/324, 325, 378, 395, 4/415

[56] References Cited

U.S. PATENT DOCUMENTS

| | | | |
|---|---|---|---|
| 3,885,253 | 5/1975 | Overbey | 4/325 |
| 4,032,997 | 7/1977 | Phripp et al. | 4/415 |
| 4,135,262 | 1/1979 | Overbey | 4/325 |
| 4,176,821 | 12/1979 | Strangfeld | 4/378 X |
| 4,566,140 | 1/1986 | Musgrove | 4/324 |
| 4,651,359 | 3/1987 | Battle | 4/415 X |
| 4,748,699 | 6/1988 | Stevens | 4/345 X |

*Primary Examiner*—Charles E. Phillips
*Attorney, Agent, or Firm*—Allen A. Dicke, Jr.

[57] ABSTRACT

An actuator tube slidably embraces the overflow tube on a toilet tank and has an actuator flange at the lower end thereof. An actuator sleeve slidably embraces the actuator tube with stops limiting the relative sliding distance. An actuator surface is also mounted on the sleeve so that, when the flapper valve at the bottom of the toilet tank is raised to release flush water, the float descends and with it descend the actuator tube and flange, as well as sleeve and actuating surface. The flange thrusts the flapper valve partway down, and the actuating surface sliding down the tube finally closes the flapper valve before all toilet tank water is released to thereby conserve water.

12 Claims, 3 Drawing Sheets

DOUBLE-ACTING WATER CLOSET METERING DEVICE

CROSS REFERENCE

This application is a division of patent application Ser. No. 07/519,430, filed May 4, 1990, for "WATER CLOSET METERING DEVICE," now U.S. Pat. No. 5,040,247, which was a division of my prior application Ser. No. 07/189,152, filed May 2, 1988, for "WATER CLOSET METERING DEVICE," now U.S. Pat. No. 4,937,895, which was a continuation-in-part of patent application Ser. No. 051,297, filed May 15, 1987, for "WATER CLOSET LIMITED VOLUME FLUSH CONTROL SYSTEM," now U.S. Pat. No. 4,748,669.

FIELD OF THE INVENTION

This invention is directed to a water closet metering device which conserves water by closing the flapper flush valve before the water is all released from the toilet tank. By utilization of the metering device, water is conserved.

BACKGROUND OF THE INVENTION

Most toilet installations include a tank mounted above the toilet bowl. A bottom outlet in the tank permits release of water from the tank to flow into the bowl. A hinged flapper valve normally overlies the outlet so that the tank can be filled. Filling is accomplished to a predetermined level by means of an inlet valve which controls water inflow from a pressurized source. A float controls the valve to shut off the valve when the selected water level is reached. An overflow is connected to the tank outlet and stands upright next to the outlet. The overflow tube prevents the overfilling of the tank. The flapper valve is usually pivoted on the overflow tube.

Toilets are normally designed so that a more than adequate amount of water is delivered to the bowl at each flush to fully flush out the contents thereof. A considerable amount of water can be saved by individually adjusting the amount of flush water discharged in each toilet to accommodate for its individual design and installation. This is defined as a limited flush, wherein the minimum amount of water is employed to flush the toilet when there are solids present. Prior to the invention defined in the parent application, described above, there was no reliable structure available which provides for metering the release of water from the tank in a toilet, particularly with adjustability of the device to accommodate different toilet designs, and particularly for after-market installation in toilets of various shapes and characteristics.

SUMMARY OF THE INVENTION

In order to aid in the understanding of this invention, it can be stated in essentially summary form that it is directed to a water closet metering device wherein a float is slidable up and down the upwardly directed overflow tube in a toilet tank and a valve actuator is mounted below the float at an adjustable position therebelow. The float and/or actuator may be configured for mounting close to the tank wall.

It is thus an object and advantage of this invention to provide a water closet metering device which a user can install in an existing toilet to provide a partial volume of toilet flush water so that water conservation can be achieved.

It is a another object and advantage of this invention to provide a water closet metering device which is useful both in new equipment and in retrofitting existing toilet structure so that a reliable and economic metering device can be readily installed in an existing standard toilet.

It is a another object and advantage of this invention to provide a water closet metering device which is economic of construction, reliable in operation, and easily installed so that the water conservation advantages of the water closet metering device can be widely enjoyed.

Other objects and advantages of this invention will become apparent from a study of the following portion of the specification, the claims and the attached drawings.

DESCRIPTION OF THE PREFERRED EMBODIMENTS

Figure 1:
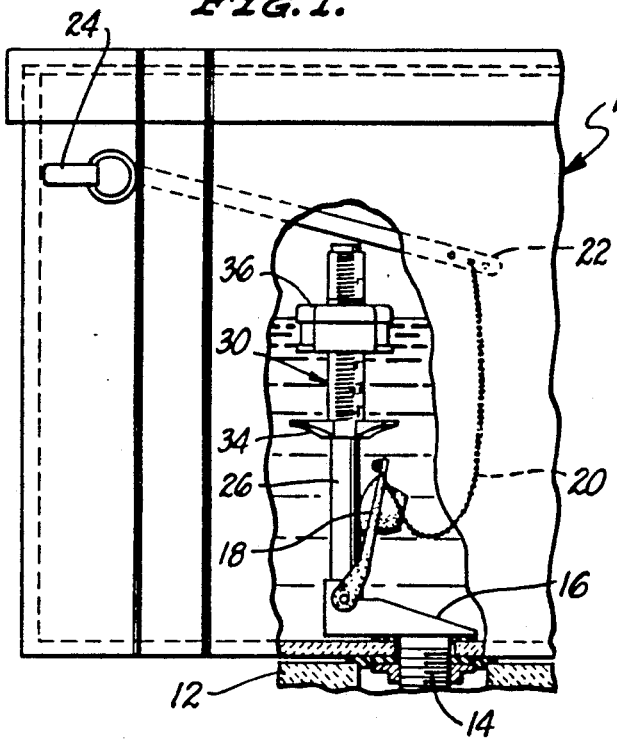
FIG. 1 is a front elevational view of a toilet tank, with parts broken away, showing the first preferred embodiment of the water closet metering device of this invention installed therein.

FIG. 1 shows a toilet tank 10 which is the water supply for a conventional siphon jet toilet. A small portion of the bowl 12 is shown at the bottom of FIG. 1, as a section through the water inlet to the bowl. The tank has an outlet fitting 14 which directs the water released from the tank into the water inlet to the bowl. Outlet fitting 14 has a valve seat 16 thereon. Flapper valve 18 pivoted on pivot pins extending from the sides of the outlet fitting so that it can move from the raised position shown in FIG. 1 to the closed position wherein the flapper valve lies on valve seat 16 to close the outlet from the bottom of the tank down into the toilet bowl. Flapper valve 18 is raised by chain 20, which is connected between the flapper valve and flush lever 22. The flush lever is manually actuated by flush handle 24 mounted on the toilet tank.

Overflow tube 26 extends upward from outlet fitting 14. The top 28 (see FIG. 2) of the overflow tube determines the maximum level to which water can rise in the toilet tank. Should the water rise higher than the top of the overflow tube, the water will run down the overflow tube through outlet fitting 14 underneath the valve and discharge into the toilet bowl. This prevents toilet tank overflow. Normal filling of the tank is accomplished by a float valve supplied by water under pressure.

Figure 2:
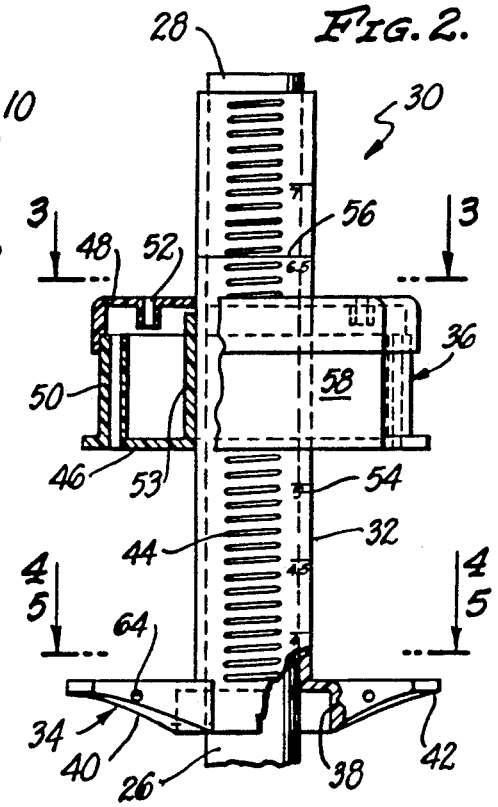
FIG. 2 is an enlarged front elevational view, with parts broken away and parts taken in section of the water closet metering device shown in FIG. 1.

Metering device 30, shown in side elevation in FIG. 2, with parts broken away, comprises upright tube 32 which is freely movable up and down the overflow tube 26. At the lower end of upright tube 32 is valve actuator 34 and mounted upon the upright tube in an adjustable position on the height thereof is float 36. In general terms, when the tank is filled to the design water level, for example the level shown in FIG. 1, the float has enough buoyancy to hold the metering device with the top of the float slightly above water level. When the flapper valve 18 is opened, as shown in FIG. 1, water is released from the tank and the water level descends. The flapper valve has its own flotation, and, in the absence of the metering device 30, the water level descends to the level of the flapper valve so that the flapper valve moves down by virtue of losing its flotation. In that case, nearly all of the water in the toilet tank is discharged. When the metering device 30 is present, the float 36 of the metering device moves down with the descending water level causing valve actuator 34 to thrust the flapper valve towards the closed position. In ordinary cases, it thrusts the valve sufficiently far closed so that the dynamic forces of the draining water engage the flapper valve and thrust it closed. Thus, the flapper valve is closed before the tank is drained to the extent it would have been drained in the absence of the metering device. Thus, water is conserved. This smaller amount of water is capable of providing an adequate toilet flush because the first portion of the water discharged during the flush has the higher head pressure due to the full tank to better accomplish the flushing task. The dynamic characteristics are much more favorable than attempting to flush using a half-full tank.

In order to descend as far as possible, valve actuator 34 has a recess 38 therein (see FIG. 2) which provides clearance to receive the collar of the outlet fitting which carries the overflow tube 26 in the lowest position. In order to maximize the downward thrust of the flapper valve 18, without having the valve actuator 34 hang up on the flapper valve 18 when it is in the raised position of FIG. 1, the valve actuator has a shallow conical lower surface 40 thereon which, as it extends radially outward, becomes curved to an even shallower cone. This radius surface is shown at 42 in FIG. 2. Upright tube 32 is integrally molded with the valve actuator 34 and is generally cylindrical on its outer surface. In order to permit vertical adjustability of float 36 along the upright length of the upright tube, the upright tube 32 is provided with interrupted threads 44.

Float 36 is formed of cup 46 and cap 48. As seen in FIG. 2, both the cup and cap are hollow and the cap engages over the cup to attach thereto. It is necessary for the entire structure of the metering device to be sufficiently heavy so that, in the absence of flotation of the float 36, there is sufficient downward force to cause the actuator 34 to thrust the flapper valve 18 in the closed direction. Ordinary synthetic polymer composition materials are about the same specific gravity as water, and thus flotation is not reliable. In order to conserve material and provide weight to the metering device when the float is not floating, float 36 is configured so that it partially, but only partially fills with ballast water. It is also configured so that a certain amount of air is retained to ensure flotation. This is accomplished by means of fill tube 50 which is formed with the cup 46 and extends from the bottom of the cup upward to the top of the cup. The top of the cup substantially defines the desired water level in the float. In order to vent the air in the float when there is incoming water in fill tube 50, vent tube 52 is provided in cap 48. Vent tube 52 extends downward within the cap and terminates at the desired water level in the float.

When the float is submerged, water flows into the float through fill tube 50. During this filling, air vents out through vent tube 52. When the water level reaches the bottom of the vent tube, no more air is vented so no more filling can take place. In this way, a precise water level within the float is achieved. With the precise water level, the desired weight of the metering device 30 is achieved. When the tank water level goes below the float water level, which may happen on occasion, water will not run out of the float. In order to prevent outflow of water along the upright tube 32 above the valve actuator, cup 46 has an upright tube 53 therein surrounding the upright tube 32. The interior of tube 53 within cup 46 has therein threads which engage upon the threads 44 on tube 32. In this way, the float can be screwed up and down tube 32 to the desired position. As seen in FIG. 2, tube 32 may have spaced indicia 54 thereon to aid in preselecting the correct height of the float on the valve actuator. In addition, tube 32 may be too tall for some installations and thus may be provided with a breakoff notch 56.

Figure 3:
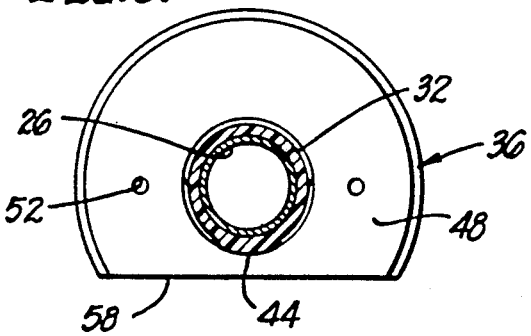
FIG. 3 is a downwardly looking view, as seen along the line 3—3 of FIG. 2.
Figure 4:
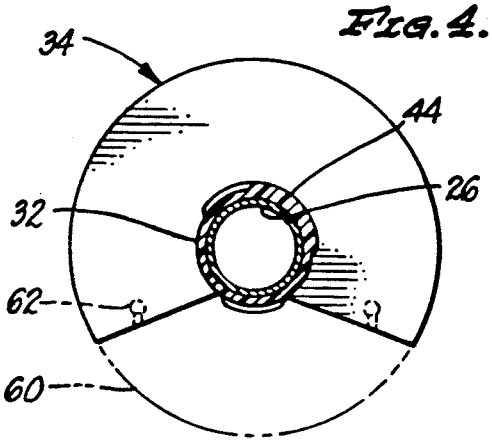
FIG. 4 is a downwardly looking view, as seen along the line 4—4 of FIG. 2, showing a first preferred valve actuator structure.

The plan view of the structure shown in FIG. 2 may be circular when overflow tube 26 is spaced sufficiently far from the walls of toilet tank 10 to permit that much space to be occupied. However, it is seen that overflow tube 26 is eccentrically mounted with respect to outflow fitting 14. Thus, the overflow tube 26 may be installed close to the front or rear wall of the tank to limit the space in which a the metering device can be installed. For this reason, the float 36 has a flat front side 58, as seen in FIG. 3. When used with adequate space, the metering device 30 preferably has a circular valve actuator 34 so that it does not matter what the rotary position of the metering device around the overflow tube may be. However, when used close to the tank wall, the flat front side 58 prevents rotation of the metering device. In order to reduce the circular valve actuator for such installations, removable panel 60 can be pulled off of the major part of the valve actuator. The removable panel 60 is formed as a separate part and is held in place by pins 62 entering corresponding opening 64, see FIG. 2, in the valve actuator. Such a panel is removable and replaceable. The bottom of the panel, the actuator side thereof, has the same conical surface 40 transitioning into an outer radiused surface 42 as the main part of the actuator.

Figure 5:
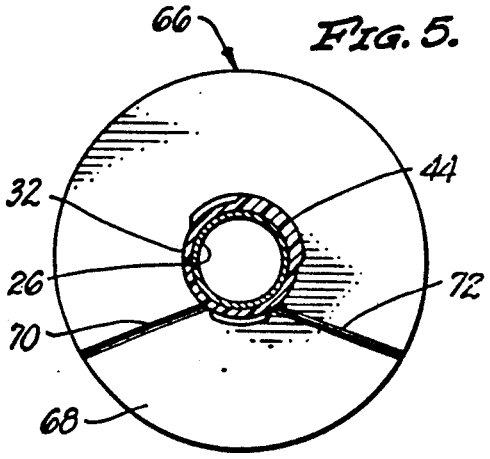
FIG. 5 is a downwardly looking view, as seen generally along the line 5—5 of FIG. 2, showing a second preferred version of the valve actuator structure.

In FIG. 5, the valve actuator 66 is shown in plan view and is attached and integrally formed with the upright tube 32. The bottom, actuator surface is the same as the valve actuator 34. What is different is that panel 68 is integrally formed with the remainder of the valve actuator, but is formed with snap-off notches 70 and 72 which permits the installer to snap off the panel 68 if the tank wall is in the way of proper operation. In the valve actuator 66, the panel cannot be replaced, as it can be in the valve actuator 34. Otherwise, the structure is the same.

Figure 6:
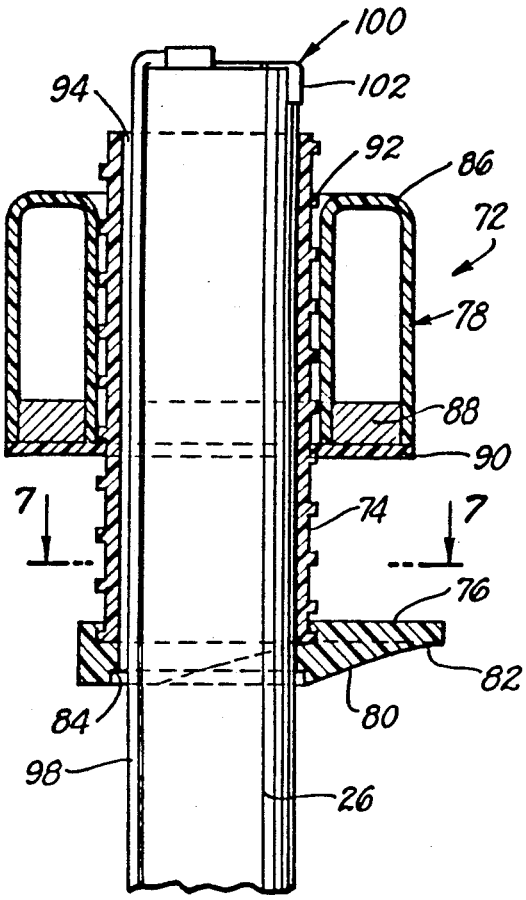
FIG. 6 is a vertical section through a second preferred embodiment of the water closet metering device of this invention.
Figure 7:
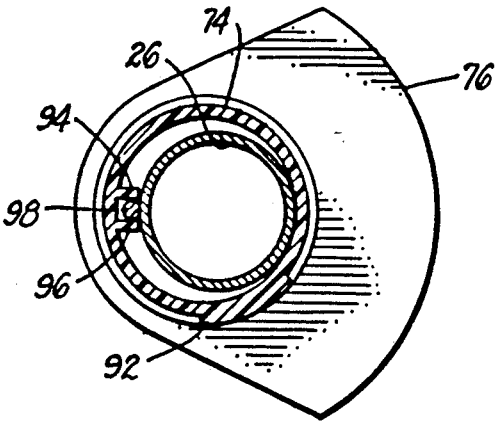
FIG. 7 is a downwardly looking view, as seen general along line 7—7 of FIG. 6.

FIG. 6 illustrates a similar metering device 72 which has an upright tube 74 with a valve actuator 76 mounted on the bottom thereof. Float 78 is securable to the upright tube at a position above the valve actuator. As seen in FIGS. 6 and 7, valve actuator 76 is not circular about the center of its upright tube, as were the previously described valve actuators. Valve actuator 76 is close to the upright tube 74 around at least half of its diameter and extends out in a flange in a segment which is less than half a circle. The under surface of this flange has the same conical surface 80 which extends outward to a radius surface 82 which is of progressively shallower conical angle as the radius increases. The valve actuator also has a recess 84 so that the valve actuator can extend down past the collar on the outlet fitting, see FIG. 10. Thus, the valve actuator 76 is the same as the previously described valve actuators, except that it is only over a circular segment of less than half a circle. Thus, the overflow tube 26 may be close to a toilet tank wall and the short radius side of the valve actuator can be directed towards the wall to eliminate interference.

In order to take advantage of this opportunity for close positioning, float 78 is a smaller diameter float. The body 86 of the float is in the form of a closed top tube or an inverted U defining a surface of revolution around the central axis of the float. The body of the float defines a considerable air space so as to provide adequate net flotation of the metering device 72 when it is floating in the tank water. In order to provide sufficient weight to the metering device when it is higher than its flotation point, weight 88 is positioned on the metering device. It is conveniently located as part of the float and, as illustrated, it is within the float cavity. The float cavity is closed by bottom cover 90 which seals the air and weight within the float. In order to achieve adjustability, the exterior of upright tube 74 is provided with threads 92. These threads clear the interior of the float, but the bottom cover 92 is configured to engage on the threads so that rotation of the float with respect to the upright tube causes axial movement of the float along the tube with respect to the valve actuator. In this way, height is adjusted. The fits between the parts are preferably sufficiently tight so that once adjusted, the parts stay in relative place so that repeated adjustment is not necessary. If preferred, float 36 could be used.

It is seen that the metering device 72 may rotate on the overflow tube 26 to a point where the valve actuator will not be in an effective position above the flapper valve. To prevent this rotation, a guide rod is provided. The interior of upright tube 74 has guide flanges 94 and 96 therein, spaced sufficiently to slidably receive guide rod 98 therebetween. Guide rod 98 is attached to the top of overflow tube 26 by means of attachment clip 100, seen in FIGS. 6, 8 and 9. Attachment clip 100 has a downwardly engaging flange 102 which is curved to embrace the exterior of the overflow tube adjacent the top. Arm 104 extends partway across the top of the overflow tube. It has a finger 106 thereon which engages interiorly of the overflow tube. Tooth 108 extends outward from the finger towards flange 102 and resiliently engages overflow tube 26 therebetween. Once installed, the attachment clip 100 is held in place by tooth 108.

Figure 8:
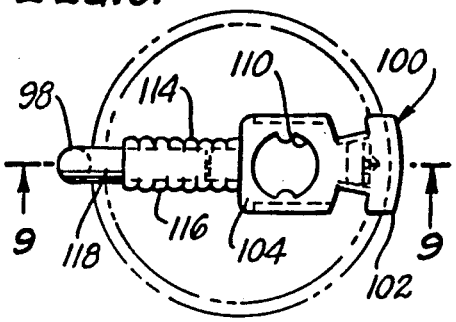
FIG. 8 is an enlarged plan view of the guide rod of FIG. 6, shown installed on the overflow pipe shown in dashed lines.
Figure 9:
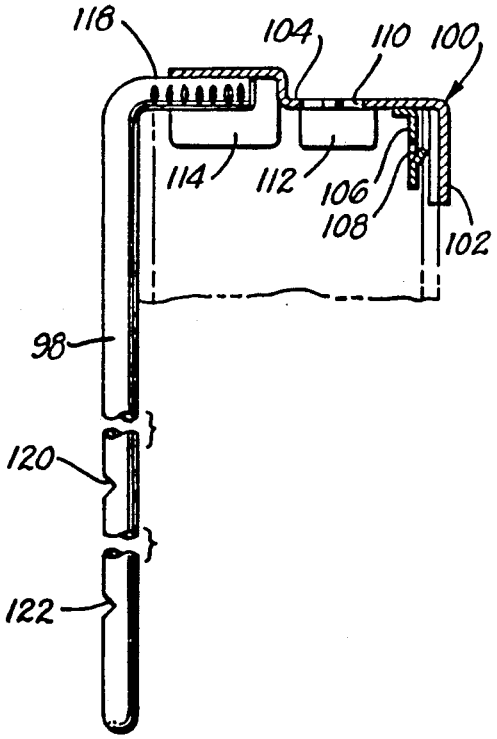
FIG. 9 is a section taken generally along the line 9—9 of FIG. 8.

Arm 104 has opening 110 therein to receive the trap filling supply tube extending from the tank filling float valve. Flanges 112 extend downward adjacent opening 110 to strengthen the arm at the opening. Beyond the opening, clamp flanges 114 and 116 are bent downward from the arm to receive the inwardly bent top rod section 118 of guide rod 98 therebetween. The rod section 118 may be notched, as shown in FIG. 9, and the flanges may be corrugated, as shown in FIG. 8, so that the clamp flanges firmly engage on the rod section to hold the guide rod 98 in any selected position around the overflow tube and hold it tightly clamped thereto with any overflow tube diameter. Guide rod 98 is sufficiently long to guide the descending metering device 72 to its lowermost position. If it is too long for a short tank, it may be broken off at notch 120 or notch 122, seen in FIG. 9. In this way, a metering device is provided which can fit upon an overflow tube which is close to the tank wall and rotation is prevented by means of the guide rod.

Figure 10:
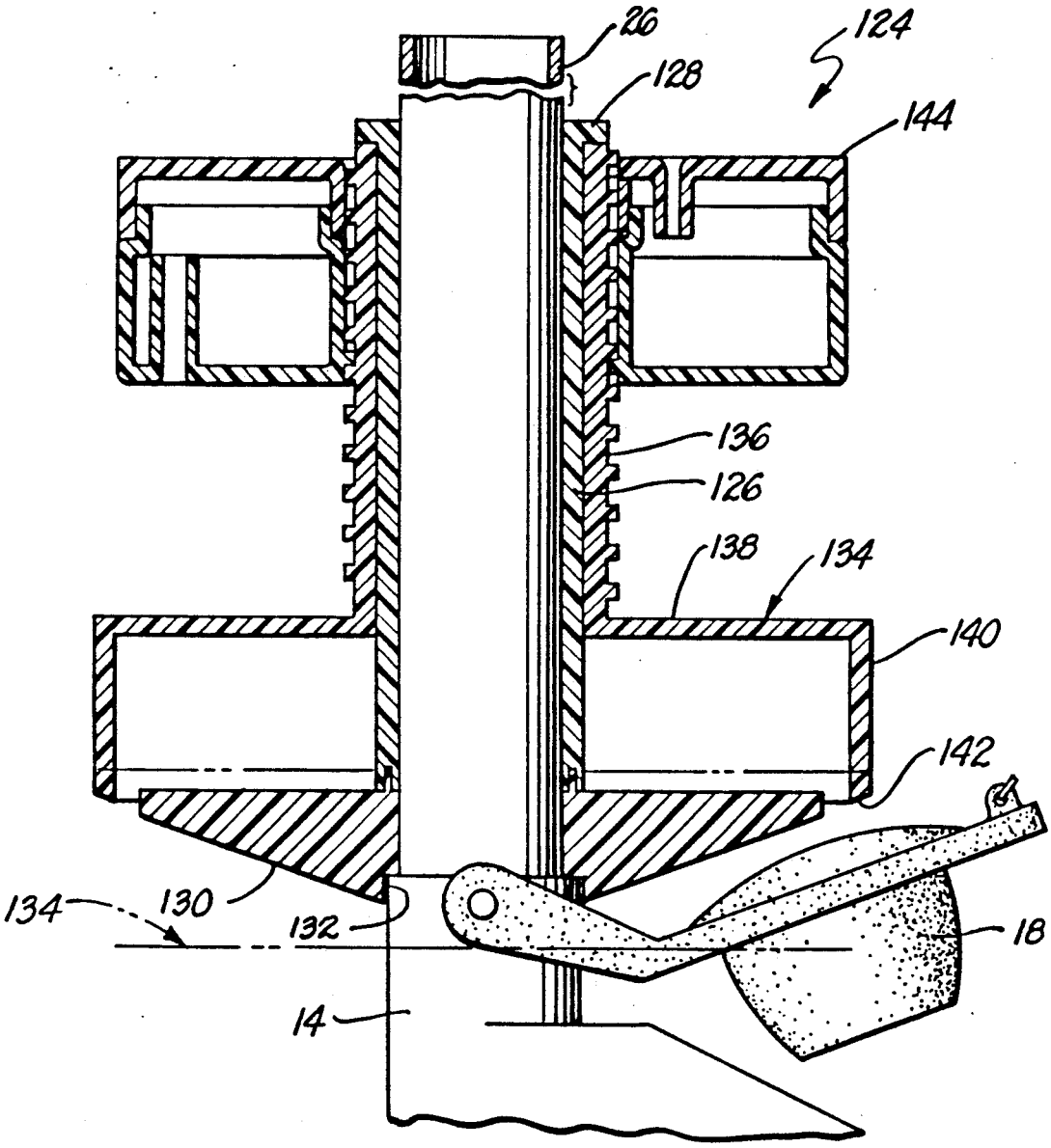
FIG. 10 is a vertical section through a third preferred embodiment of the water closet metering device of this invention.

Metering device 124 is shown in FIG. 10. Metering device 124 is mounted on overflow tube 26. The overflow tube is mounted upon outlet fitting 14, which is shown broken away in FIG. 10. Flapper valve 18 is shown as pivoted on pivot pins carried on the outlet fitting. This structure is the same as shown in FIG. 1. Metering device 124 comprises sleeve 126 which is tubular and slidably mounted up and down on overflow tube 26. The upper end of sleeve 126 carries stop flange 128 extending outward at the upper end thereof, and its lower end it carries valve actuator 130. The stop flange 128 and/or the valve actuator 130 are made as a separate piece which is attached upon assembly. Valve actuator 130 is shown in its lowered position, with the top of fitting 14 received in recess 132 on the interior of the actuator. Valve actuator 130 is in the form of a shallow cone having a total included apex angle between 140 and 175 degrees and more preferably of about 141 to 142 degrees, the same as the conical surfaces 40 and 80. The conical surface on the underside of valve actuator 130 does not need the radius surface, such as shown in FIGS. 2 and 6.

In FIG. 10, sleeve 126 and its valve actuator 130 are shown in the lowermost position and show the flapper valve 18 thrust towards its closed position. In this position, the buoyancy of the flapper valve 18 urges it upward, and the dynamic flow forces of the water being released urge the flapper valve 18 downward towards its closed position. This is a critical position of the flapper valve, and to ensure that the flapper valve 18 is thrust downward far enough to assuredly cause closing of the flapper valve, a secondary valve actuator 134 is provided. The secondary valve actuator 134 comprises sleeve 136 which is slidably mounted on the sleeve 126 to move between stop 128 and the top surface of valve actuator 130. Flange 138 extends outwardly parallel to the top of valve actuator 130, and the outer edge of flange 138 carries ring 140 thereon. Ring 140 is annular and is large enough to engage down outside of valve actuator 130, as shown in dashed lines in FIG. 10. Ring 140 preferably has a conical surface 142 thereon which is a continuation of the conical surface of the bottom of actuator 130. From the position shown in FIG. 10, when secondary valve actuator 134 moves down to the dashed line position, it thrusts the flapper valve 18 farther down than the actuator valve 130 could accomplish. In this way, the closure of the flapper valve is assured.

Float 144 is mounted upon sleeve 136 and is adjustable up and down the length thereof to achieve the desired height relationship between the float and the valve actuator surface 130. This is accomplished by the interrupted threads, as taught in FIGS. 2 and 6. Float 144 may be of the type shown in FIGS. 2 and 6 rather than the single closed float illustrated. When the toilet is flushed and the water descends, valve actuator 130 hangs down in the position shown, with the buoyancy of float 144 transferred through sleeve 136 to support the valve actuator 130 by means of stop 128. At an intermediate point, the descending water level causes valve actuator 130 to thrust the flapper valve towards the closed position. When the flapper valve 130 reaches its lowermost position shown in FIG. 10, further drop in the water level permits the float and secondary valve actuator 134 to descend to a point where surface 142 engages on the flapper valve 18 to thrust it down to a position where it will be assuredly closed by dynamic fluid flow forces. In this way, water conservation is achieved.

This invention has been described in its presently contemplated best modes, and it is clear that it is susceptible to numerous modifications, modes and embodiments within the ability of those skilled in the art and without the exercise of the inventive faculty. Accordingly, the scope of this invention is defined by the scope of the following claims.

WHAT IS CLAIMED IS:

1. A water closet metering device from which position said float will drop with a receeding water level comprising:

an actuator flange;

an actuator tube attached to said actuator flange and extending upwardly therefrom, said actuator tube having an open interior for sliding embrace on the overflow tube of a toilet tank, said actuator flange having a downwardly directed face for engaging against the flapper valve adjacent the overflow tube for thrusting the flapper valve towards the closed position;

a sleeve engaged on and slidable with respect to said actuator tube, an actuator surface mounted on said sleeve and positioned to move below said actuator flange;

a float mounted on said sleeve, a stop on said actuator tube to be engaged by said sleeve to limit upward motion of said sleeve on said actuator tube to a raised position where said actuator surface is not below said actuator flange from which position said float will drop with a receeding water level to a position where said actuator surface is below said actuator flange.

2. The water closet metering device of claim 1 wherein said float is adjustably mounted with respect to said sleeve.

3. The water closet metering device of claim 2 wherein said actuator surface on said sleeve is a conical annular surface which engages down around said actuator flange when said sleeve is in its lowered position.

4. The water closet metering device of claim 2 wherein said sleeve has projections thereon and said float has corresponding projections thereon so that the position of said float can be adjusted with respect to said engagement surface on said sleeve by interengagement of said projections.

5. The water closet metering device of claim 1 wherein said actuator surface on said sleeve is a conical annular surface which engages down around said actuator flange when said sleeve is in its lowered position.

6. A water closet metering device from which position said float will drop with a receeding water level comprising:

an actuator flange having a downwardly directed face for engaging against the flapper valve for the thrusting of the flapper valve toward the closed position;

an actuator tube attached to said actuator flange and extending upwardly therefrom, said actuator tube having an open interior for sliding embrace on the overflow tube of a toilet tank;

a sleeve engaged on and slidable with respect to said actuator tube, an actuator surface mounted on said sleeve and positioned to move below said actuator flange;

stops interengaging said sleeve and said actuator tube to limit the upward motion of said sleeve on said actuator tube from a raised position where said actuator surface is not below said actuator flange to a position where said actuator surface is below said actuator flange; and a float mounted on said sleeve so that when in water, said float raises said sleeve and said actuator surface with respect to said actuator tube and said actuator flange and when said sleeve reaches a stop on said actuator tube, said float raises said actuator tube and said actuator flange.

7. The water closet metering device of claim 6 wherein said actuator surface is on a ring which embraces said actuator flange.

8. The water closet metering device of claim 7 wherein said float is adjustably mounted on said sleeve.

9. The water closet metering device of claim 8 wherein said float has a top and has a bottom and has a hollow interior and said float has a fill tube therein extending from said bottom up into said hollow interior to a preselected level therein and said top has a vent tube therein extending downward from said top substantially to said preselected level so that when in the toilet tank, water fills the hollow interior of said float substantially to said preselected level so as to provide weight to said metering device when tank water level descends.

10. The water closet metering device of claim 6 wherein said float is adjustably mounted on said sleeve.

11. The water closet metering device of claim 10 wherein said float has a top and has a bottom and has a hollow interior and said float has a fill tube therein extending from said bottom up into said hollow interior to a preselected level therein and said top has a vent tube therein extending downward from said top substantially to said preselected level so that when in the toilet tank, water fills the hollow interior of said float substantially to said preselected level so as to provide weight to said metering device when tank water level descends.

12. The water closet metering device of claim 6 wherein said float has a top and has a bottom and has a hollow interior and said float has a fill tube therein extending from said bottom up into said hollow interior to a preselected level therein and said top has a vent tube therein extending downward from said top substantially to said preselected level so that when in the toilet tank, water fills the hollow interior of said float substantially to said preselected level so as to provide weight to said metering device when tank water level descends.

* * * * *